United States Patent [19]

Ubukata et al.

[11] Patent Number: 4,493,066

[45] Date of Patent: Jan. 8, 1985

[54] SEISMOSENSITIVE DEVICE

[75] Inventors: Susumu Ubukata; Yasukazu Mizutani, both of Nagoya, Japan

[73] Assignee: Susumu Ubukata, Nagoya, Japan

[21] Appl. No.: 526,498

[22] Filed: Aug. 25, 1983

[30] Foreign Application Priority Data

Jun. 10, 1983 [JP] Japan ..... 58-104576

[51] Int. Cl.[3] ..... H01H 29/00

[52] U.S. Cl. ..... 367/178; 367/188; 200/61.47; 200/220; 200/222; 200/229; 200/234

[58] Field of Search ..... 200/61.47, 61.52, 222, 200/235, 220, 223, 224, 229, 234; 367/178, 188, 912; 181/102, 112

[56] References Cited

U.S. PATENT DOCUMENTS 4,066,859 1/1978 Steinmetz ..... 200/235

4,099,040 7/1978 Bitko ..... 200/61.47

*Primary Examiner*—Nelson Moskowitz

*Assistant Examiner*—Ian Lobo

*Attorney, Agent, or Firm*—Karl L. Spivak

[57] ABSTRACT

A seismosensitive device comprises a hermetically sealed enclosure having a recess at the bottom, a first annular surface provided around the recess and having a radial gradient substantially of horizontal level and a second annular surface provided around the first annular surface and progressively diverging from the lower to upper portions with a slope having a gradient greater than that of the first annular surface. A switch assembly comprising a drop of mercury placed at the recess, an electrode bar provided with the enclosure, a needle contact secured to the electrode bar to have its lower end immersed into the drop is provided. When the mercury drop moves along the gradient surfaces significantly smoothly to separate from the needle contact upon tremor of the earth, the switch will open.

8 Claims, 2 Drawing Figures

SEISMOSENSITIVE DEVICE

BACKGROUND OF THE INVENTION (1) Field of the Art

This invention concerns a seismosensitive device which is arranged to open a switch means upon tremor of the earth so as to prevent a heating apparatus or the equivalent from developing into an abnormal condition and more particularly relates to a seismoscope in which said switch means comprises a drop of mercury and an electrode means having its lower end immersed into the drop.

(2) Description of the Prior Art

In a seismosensitive device in which a drop or globule of mercury is incorporated as an inertia mass, since the globule itself serves as a movable contact, the device has the capability of reducing size and frictional loss compared with counterpart prior devices in which a snap-action contact mechanism such as a microswitch is employed to be off-actuated by means of inertia mass such as a solid ball, pendulum or the like when an earthquake occurs.

This makes us induce the following requirements to be taken into consideration. One is that the physical condition of the surface where the mercury globule is to be placed affects its moving characteristics to a significant degree. The other is that when a globule of mercury is reduced to below 1 g in weight, it ends to retain itself in substantially spherical configuration under the influence of surface tension and not to conform to the shape of the enclosure in which the drop is placed.

SUMMARY OF THE INVENTION

It is therefore a primary object of the present invention to provide a novel seismosensitive device in which the above requirements are taken into consideration.

Accordingly, it is an object of the invention to provide a seimosensitive device small in size and light in weight.

It is another object of the invention to provide a seismosensitive device having uniform sensitivity within a certain range of frequency associated with an earthquake.

It is still another object of the invention to provide a seismosensitive device which is immune to exterior disturbances caused by other than an earthquake to obviate malfunction.

It is a further object of the invention to provide a seismosensitive device which allows delayed time for a switch means between its on-and-off actuated length upon tremor of the earth, thus holding the switch means off-actuated for a predetermined period of time.

It is another object of the invention to provide a seismosensitive device which allows a low electrical contact resistance between a mercury globule and an enclosure in which the globule is placed to maintain the low contact resistance condition for a long period of time.

According to the invention, there is provided a seismosensitive device comprising a hermetically sealed enclosure; a recess provided at the bottom of the enclosure; a first annular surface provided around the recess and having a radial gradient substantially of horizontal level; a second annular surface provided around the first annular surface and progressively diverging from the lower to upper portions with a slope having a gradient greater than that of the first annular surface; a switch means comprising a globule of mercury placed at the recess; an electrode means mounted on the enclosure to have its lower portion positioned therein; and a needle-shaped contact having its upper end secured to the electrode means while its lower portion is immersed into the globule of mercury; whereby, when the mercury globule moves along the first and second annular surfaces in a significantly smooth manner to separate from the electrode means it serves upon to off-actuate the switch means tremor of the earth.

The above and other objects, features and advantages of the present invention will become apparent from the following description and the appended claims, taken in conjunction with the accompanying drawings which shows by way of example preferred embodiments of the present invention and in which like component parts are designated by like reference numerals throughout various figures.

BRIEF DESCRIPTION OF THE DRAWINGS

In the accompanying drawings.

DESCRIPTION OF THE PREFERRED EMBODIMENT

Figure 1:
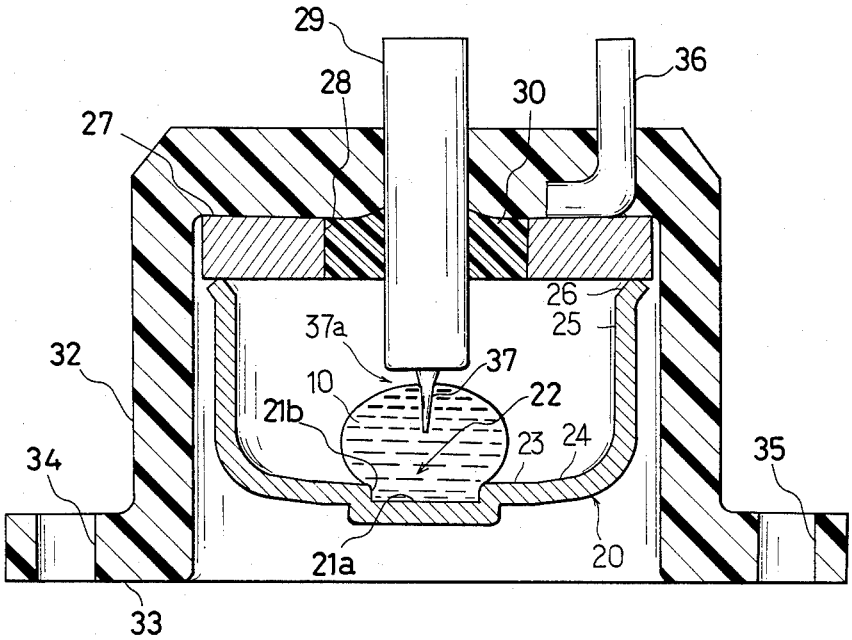
FIG. 1 is a longitudinal cross sectional view of a seismosensitive device according to one embodiment of the invention.

Referring to the drawing of FIG. 1, there is shown a seismosensitive device according to one embodiment of the invention. An electrically conductive enclosure 20 is made from, for example, an iron sheet by means of drawing. The enclosure 20 has a central recess 22 at its bottom to have the circumferential surface serve as a generally vertical uprise wall **21*b* while the lowest surface as a bottom portion 21*a*. At the inner bottom of the enclosure 20 is an annular-shaped low gradient surface 23 provided around the wall 21*b* in concentric relationship with the outer periphery of the uprise wall 21*b*, the gradient of the surface 23 being substantially horizontal. Around the outer periphery of the annular surface 23 is an annular-shaped high gradient surface 24 concentrically provided, the gradient of which is greater than that of the surface 23. The high gradient surface 24 has its outer periphery integrally extend to join the generally vertical wall 25 of the enclosure 20, the top of which has a flared portion 26. A lid plate 27, which is made from, for example, a sheet of iron by means of stamping, has a central aperture 28 into which an electrode bar 29 is air-tightly inserted to be encapsulated by means of an electrically insulated filler such as, for example, a glass sealant 30. The lid plate 27 has its outer periphery air-tightly secured to the flared portion 26 of the enclosure 20 by means of ring projection welding or the like so as to form a hermetically sealed construction. The construction is enclosed by suitable means into a housing 32 which is of electrically insulated material such as synthetic resin or the like. The housing 32 has its lower outer periphery integrally extend outward to form an annular flange 33 which is provided with holes 34, 35 to secure the housing 32 to a suitable structure such as a heating apparatus by means of screws or the like. In this instance, the flange 33 has its surface conform to the horizontal level to occupy a normal position in which when a globule of mercury 10 is placed into the recess 22, it will be maintained stationary. In so doing, the mercury globule 10 is positioned to permit immersion of an electrically conductive needle 37 which serves as a contact, so that an electrical signal is generated by connecting the electrode bar 29 and the lid plate 27 to a suitable exterior electrical circuit (not shown) via a connector piece 36 mounted on the lid plate 27. The needle 37 immersed into the mercury drop or globule as mentioned above constitutes a switch means 37***a* in cooperation with the electrode bar 29 and the drop 10.

The inner surface of the enclosure 20 is fabricated of high roughness configuration. Assuming that the inner surface of the enclosure 20 is of sufficiently smooth configuration, the mercury drop, once contacted with the above surface, would undergo a gradual deformation into a flat-shaped configuration with the elapse of time under the influence of increased adhesion between the enclosure and the drop for the reason that the angle of contact between the drop and the enclosure gradually decreases. The drop, thus flatwise deformed, would cause an increase in the contact area against the inner surface of the enclosure with the result of a large adhesion being set up therebetween, so that the threshold value that is, the minimum magnitude of tremor necessary to have the drop move to separate from the needle would increase with the passage of time to render the device less sensitive.

With this in mind, the enclosure 20 has, by way of example, a rough surface configuration at its inner surface provided by means of a mechanical method such as sand-blasting, liquid honing or the like, or a chemical method such as etching or the like. The rough surface configuration is preferably defined minute to decrease the contact area between the drop or mercury globule and the surface of the enclosure.

With this structure, the rough surface configuration allows smaller contact area between the drop and the enclosure to lessen the adhesion set up therebetween, and maintain the adhesion in the lessened condition, thus ensuring substantially uniform threshold value that is, a minimum amount of force required to have the drop move to separate from the needle when subjected to and earth tremor.

Such is the construction that a drop of about 1 g in weight retains itself in generally spherical configuration under the influence of surface tension with its minor lower portion in the recess 22 and with its major upper portion in the hollow space within the enclosure 20 as seen in FIG. 1.

In general, a seismoscope thus that has been introduced has its threshold value standardized to be responsive to the tremor having a frequency ranging from $0.3^{-1}$ sec.$^{-1}$ to $0.7^{-1}$ sec.$^{-1}$ similar to that of a usual earthquake. It is, needless to say, desirable that the seismoscope have uniform sensitivity within the above range. In view of this, for those instances where the gradient surface at the bottom of the enclosure comprises the high gradient surface only, the mercury globule, once it is vibrated over the uprise wall 21*b* to reach the surface, will have a tendency to descend over the surface under the influence of the surface-oriented component of gravity. This impedes any tendency of the globule to smoothly separate from the needle, and thus varies the threshold value depending upon the frequency exerted upon the enclosure. By way of example, it requires a relatively small threshold value such as 170 gal to separate the drop from the needle upon sensing a tremor having a frequency of $0.3^{-1}$ sec.$^{-1}$, while it requires a relatively high threshold value such as 230 gal upon sensing a tremor having a frequency of $0.7^{-1}$ sec.$^{-1}$.

In contrast, such is the manner of the enclosure according to the embodiment of the invention that the low gradient surface 23 permits the mercury globule a minimum tendency of moving back toward the recess because the globule becomes substantially immune to the surface-oriented component of gravity of the tremor. This makes it possible to smoothly move the drop so as to separate it from the needle, ensuring substantially uniform threshold value regardless of the frequency ranging from $0.3^{-1}$ sec.$^{-1}$ to $0.7^{-1}$ sec.$^{-1}$.

In this instance, each radial length of the gradient surfaces 23, 24 is determined in appropriate proportion so as to move the globule back to the recess 22 when the earthquake has passed.

There is a proper dimensional distribution of the drop between where it is positioned in the recess and where it is swelling out of the recess as one of the factors to have an influence upon the sensitivity of the seismoscope. According to one of our experiments, the uprise wall of the recess was and mercury weighing 0.035 g was employed. The mercury globule measured 0.5 mm in height admits the 0.35 g weighing mercury drop, which holds 2.8 mm in height and 3.8 mm in diameter, in a manner that the uniform sensitivity was generally maintained. With this fact taken into consideration, the most appropriate quantity of mercury can be determined since the sensitivity has a close relationship with the threshold value of acceleration, which the seismoscope is sustained from.

In addition, the seismoscope is under the condition to undergo exterior disturbances caused by touching a heating apparatus in which the seismoscope is installed, or carrying some materials along the apparatus. Those exterior disturbances so far observed ranges from 300 gal to 500 gal, the frequency of which is $0.1^{-1}$ sec.$^{-1}$ at lowest.

It is therefore of importance to make the seismoscope immune to the exterior disturbances. Variously attempted experiments show that the depth of the needle within the drop is generally one-third of the vertical height of the mercury globule to satisfy the above requirement.

Furthermore, it is by no means straightforward that the needle will be positioned at the very center of the drop because of its surface tension, and at the same time, to allow the droplet to be positioned in the center of the recess when the globule is moved back along the gradient surfaces toward the recess, particularly for those instances where the globule is such a tiny quantity as not more than 1 g in weight. In accordance with our experiments, when a mercury drop of 0.35 g in weight and a needle of 0.43 mm in diameter were taken as one example, the globule snuggly moved back to concentrically position at the very center of the recess with 90 percent probability. It is the case with a needle of 0.5 mm in diameter that the globule concentrically positioned at the recess with only 10 percent probability, that is with 90 percent probability that the globule would eccentrically positions at the recess when it moved back to the recess. It is the case with a needle of as thin as 0.38 mm in diameter that the globule concentrically positioned at the recess with 100 percent probability. With regard to a globule weighing less than 1 g, those experimental results determined that the diameter of the needle should be less than one-tenth of the lateral diameter of the drop so as to satisfy the requirement. It is noted in this instance, that the needle has only its lower end reduced in diameter. Otherwise, the needle could deform to result in quality collapse.

In addition, when a seismoscope actuates to open a switch means in response to an earth tremor, it is of great importance whether or not the seismoscope can allow the switch means to open a long holding period of time ranging, for example, from 10 msec. to 100 msec. in lieu of a short few miliseconds which is generally regarded as malfunction.

It is possible to meet this requirement by reducing the depth of a needle insertion within the globule. However, this apparently runs counter to the measure taken for the purpose of making a seismoscope immune to exterior disturbances. Accordingly, it is necessary to ensure that the switch means can open for a sufficiently long holding period of time with the seismoscope made immune to the exterior disturbances. This is satisfied with a proper dimensional distribution of the globule between the portion in the recess and the portion swelling out of the recess, and a proper rate arrangement of the radial width of high and low gradient surfaces. In this instance, the former must be carefully carried out taking into account that it has close relationship with both sensitivity and threshold value of acceleration. On the other hand, upon arranging the latter, it should be taken into consideration that the relatively large low gradient surface allows the switch means to open for a lengthened holding time period, while reducing the tendency to move back the globule therealong, thus has possibility of preventing the globule from moving back in those instances where the seismoscope is slantwise installed.

Figure 2:
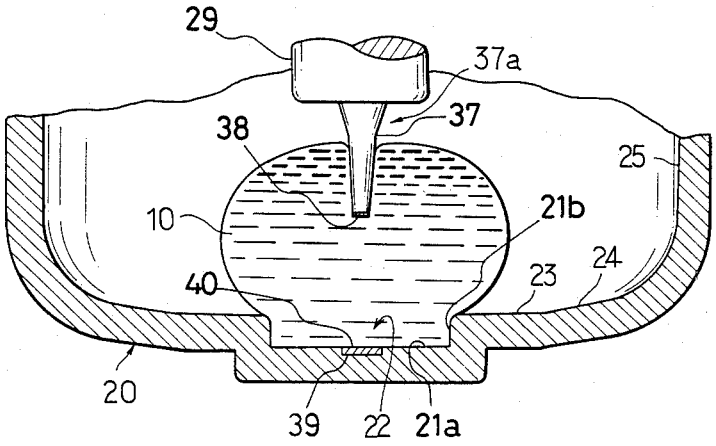
FIG. 2 is an enlarged view similar to FIG. 1 according to a modification form of the invention, but partly broken away.

FIG. 2 shows a longitudinal cross sectional view of the main components according to a modified form of the invention. The needle 37 has a nickel layer 38 attached to its crosswise surface of its lower extremity by means of plating or the like so as to enhance the wetting relationship with the mercury globule 10. A small cavity 39 is provided in the recess 22 and at the central portion thereof, a pad piece 40 made from a stamped sheet of nickel is press fitted to enhance the wetting relationship with the mercury globule 10 as is the case with the nickel layer 38. This enables electrical contact resistance values to be reduced, and maintains the values in the reduced condition between the electrode 29 and the drop 10, and between the enclosure 20 and the globule 10.

The construction is identical to that of the preceding embodiment except for improved wetting relationship, so that the same effects as previously mentioned are obtained.

It is noted that the enclosure 20 is filled with inert or reductive gases to prevent the mercury globule from being oxidized. This prohibits its deterioration and functions to maintain the initial high sensitive condition for a long period of time.

As is apparent from the foregoing description, the present invention has a number of advantages over the prior counterparts. Namely, the invention permits the device to be small in size and light in weight with high dependability, and at the same time, ensures maintenance of its high sensitive condition, thus allowing high industrial value.

While the form of invention now preferred has been disclosed as required by statute, other forms may be used, all coming within the scope of the claimed subject matter which follows.

What is claimed is:

1. A seismosensitive device comprising;

(a) an enclosure having a bottom and being fabricated of an electro-conductive material, the enclosure sealing a mercury globule therewithin;

(b) a recess formed at the bottom of the enclosure for bedding a quantity of the mercury globule, the recess being defined by a bottom portion and a vertical uprise wall extending upwardly from the bottom portion, (c) the enclosure bottom comprising a first annular low gradient surface extending outwardly from the side of the recess, the first annular surface being defined by a relatively small gradient, and a second annular high gradient surface extending from and surrounding the external side of the first annular surface, the gradient of the second annular surface being larger than the gradient of the first annular surface to return the mercury globule into the recess;

(d) a first electrode means mounted in electrically insulated relation on the enclosure to contact the mercury globule and a second electrode electrically conductively connected to the enclosure;

(e) a shaped contact supported within the enclosure by the first electrode means, the contact projecting into the the mercury globule when the mercury globule is bedded in the recess;

whereby the mercury globule will tend to remain within the recess in the state of a coaxial alignment with the center of the recess.

2. The seismosensitive device of claim 1 wherein the relative volume of the recess and the relative volume of the mercury globule are such that the mercury globule will form a substantially spherical configuration of a measurable diameter above the recess.

3. The seismosensitive device of claim 2 wherein the shaped contact is needle-shaped and the diameter of the needle-shaped contact is less than the diameter of the mercury globule when the mercury globule is embedded within the recess.

4. The seismosensitive device of claim 1 wherein the inner surface of the enclosure bottom is roughened, the roughened bottom surface being mercury-unwettable.

5. The seismosensitive device of claim 1 wherein the mercury globule weighs no more than one gram under normal atmosphere conditions.

6. The seismosensitive device of claim 1 wherein the depth of projection of the contact into the mercury globule is approximately one-third of the height of the mercury globule.

7. The seismosensitive of claim 1 wherein metallic pad pieces which are made of a mercury-wettable material are affixed to both the recess and to the contact.

8. The seismosensitive device of claim 1 wherein the first low gradient annular surface is of constant grade.

* * * * *